US011183009B2

(12) United States Patent
Vilardo

(10) Patent No.: US 11,183,009 B2
(45) Date of Patent: Nov. 23, 2021

(54) ONLINE GAMING PLATFORM USING A GRID CONFIGURATION

(71) Applicant: Matthew Vilardo, Jersey City, NJ (US)

(72) Inventor: Matthew Vilardo, Jersey City, NJ (US)

( * ) Notice: Subject to any disclaimer, the term of this patent is extended or adjusted under 35 U.S.C. 154(b) by 0 days.

(21) Appl. No.: 16/661,187

(22) Filed: Oct. 23, 2019

(65) Prior Publication Data

US 2020/0134971 A1 Apr. 30, 2020

Related U.S. Application Data

(60) Provisional application No. 62/753,450, filed on Oct. 31, 2018.

(51) Int. Cl.
*G07F 17/32* (2006.01)

(52) U.S. Cl.
CPC ..... *G07F 17/3227* (2013.01); *G07F 17/3223* (2013.01); *G07F 17/3258* (2013.01); *G07F 17/3274* (2013.01)

(58) Field of Classification Search
CPC ..... G07F 17/3223; G07F 17/3258; G07F 17/3274; G07F 17/3288; A63F 13/828
See application file for complete search history.

(56) References Cited

U.S. PATENT DOCUMENTS

| | | | | |
|---|---|---|---|---|
| 10,596,468 | B2 * | 3/2020 | Maggio | A63F 13/20 |
| 2009/0215527 | A1 * | 8/2009 | Lipscomb | G07F 17/3276 463/25 |
| 2014/0274332 | A1 * | 9/2014 | Carlin | G07F 17/3288 463/25 |
| 2015/0080124 | A1 * | 3/2015 | Andersen | G07F 17/3288 463/31 |
| 2015/0325085 | A1 * | 11/2015 | O'Hagan | G07F 17/3286 463/16 |
| 2019/0272710 | A1 * | 9/2019 | Maggio | G07F 17/3223 |
| 2019/0279467 | A1 * | 9/2019 | Saunders | G07F 17/3258 |
| 2019/0318577 | A1 * | 10/2019 | O'Hagan | G07F 17/3251 |

* cited by examiner

*Primary Examiner* — William H McCulloch, Jr.
*Assistant Examiner* — Ankit B Doshi
(74) *Attorney, Agent, or Firm* — Millen, White, Zelano & Branigan, P.C.; William Nixon

(57) ABSTRACT

An online gaming system allows players to select squares in a grid that corresponds to a game. The game includes two teams. One team is assigned to the rows of the grid and the other team is assigned to the columns. Numbers are randomly assigned to each row and each column such that each square is uniquely located according the random numbers based on the row and the column. During the game, a payout event occurs such that the scores for each team are used to identify a corresponding row and corresponding column. A winning square is identified using the row and column corresponding the scores. The player having the winning square automatically receives a prize or winnings.

9 Claims, 10 Drawing Sheets

ONLINE GAMING PLATFORM USING A GRID CONFIGURATION

FIELD OF THE INVENTION

The present invention relates to a platform that allows users to wager on sporting events online using a grid configuration that randomly assigns the conditions for winning the wager.

DESCRIPTION OF THE RELATED ART

The availability of gambling online regarding sporting events, such as football, basketball, or baseball games, has exploded over the last several years. In addition to traditional wagers on the winners of games, online sports gambling includes fantasy sports that allows a greater arbiter of success than straight winning and losing. In fact, fantasy sports have driven the success of online gambling. Today, one can even gamble daily online using well known websites that allow users to select "fantasy teams" of specific players as well as the traditional wagers on the outcomes of games.

One issue regarding the current state of online gambling is the lack of availability to games for the casual or even unknowledgeable sports fan. To truly have a chance at winning online, one had to understand the sports, teams, and players involved. For example, a points spread may tip the probability of success for a typical bet towards a specific team. The user would need to know the teams and specific knowledge of the teams to make an informed decision on who to pick. With regards to fantasy sports, the need to understand entire leagues, players, coaches, team philosophies, and so on requires a lot of research to successfully compete. Some fantasy gambling sites suffer from scams or systems that take advantage of unknowledgeable or casual sports fans.

SUMMARY OF THE INVENTION

A method for hosting an online match corresponding to a game over a network is disclosed. The game includes two teams or sides, with each team having a score. The method includes generating a grid having a plurality of rows and a plurality of columns for the online match. The grid includes a plurality of squares. Each square of the plurality of squares has a unique location within the grid corresponding to random numbers assigned to each row of the plurality of rows and to each column of the plurality of columns. A first team is associated with the plurality of rows and a second team is associated with the plurality of columns. The method also includes receiving a selection for one or more squares within the grid according the rows and columns. The selection corresponds to a purchase amount based on the number of selected squares. The method also includes receiving payment of the purchase amount over the network. The method also includes repeating the receiving steps until the grid is full or ready to close. The method also includes determining a score for the first team and a score for the second team at a payout event during the game. The method also includes identifying a winning square from the plurality of squares based on the scores. The score for the first team is used to identify a row in the grid and the score of the second team is used to identify a column in the grid that includes the winning square. The method also includes paying a prize or winning amount based on the winning square.

A method for placing a bet for an online match corresponding to a game is disclosed. The game includes two teams or sides, with each team having a score. The method includes accessing the online match through an application or website. The method also includes selecting one or more squares in a grid. The grid includes a plurality of rows associated with a first team and a plurality of columns associated with a second team. Each row has a randomly assigned number and each column has a randomly assigned number. The method also includes paying a purchase amount based on the number of selected squares. Each selected square has a unique location within the grid based on its position within the plurality of rows and the plurality of columns The method also includes determining a score for the first team and a score for the second team at a payout event during the game. The method also includes identifying a winning square for the payout event by row identified from the score for the first team and a column identified by the score of the second team. The method also includes automatically paying a prize or winnings based on the winning square.

An online gaming system for hosting an online match corresponding to a game over a network is disclosed. The game includes two teams or sides, with each team having a score. The online gaming system is configured to generate a grid having a plurality of rows and a plurality of columns for the online match. The grid includes a plurality of squares. Each square of the plurality of squares has a unique location within the grid corresponding to random numbers assigned to each row of the plurality of rows and to each column of the plurality of columns. A first team is associated with the plurality of rows and a second team is associated with the plurality of columns. The online gaming system also is configured to receive a selection for one or more squares within the grid according the rows and columns. The selection corresponds to a purchase amount based on the number of selected squares.

The online gaming system also is configured to receive payment of the purchase amount over the network. The online gaming system also is configured to repeat the receive action until the grid is full or ready to close. The online gaming system also is configured to determine a score for the first team and a score for the second team at a payout event during the game. The online gaming system also is configured to identify a winning square from the plurality of squares based on the scores. The score for the first team is used to identify a row in the grid and the score of the second team is used to identify a column in the grid that includes the winning square. The online gaming system also is configured to pay a prize or winning amount based on the winning square.

An online gaming system for placing a bet for an online match corresponding to a game is disclosed. The game includes two teams or sides, with each team having a score. The online gaming system is configured to access the online match through an application or website. The online gaming system also is configured to select one or more squares in a grid. The grid includes a plurality of rows associated with a first team and a plurality of columns associated with a second team. Each row has a randomly assigned number and each column has a randomly assigned number. The online gaming system also is configured to pay a purchase amount based on the number of selected squares. Each selected square has a unique location within the grid based on its position within the plurality of rows and the plurality of columns The online gaming system also is configured to determine a score for the first team and a score for the second team at a payout event during the game. The online gaming system also is configured identify a winning square for the payout event by row identified from the score for the first team and a column identified by the score of the second team. The online gaming system also is configured to automatically pay a prize or winnings based on the winning square.

BRIEF DESCRIPTION OF THE DRAWINGS

Various other features and attendant advantages of the present invention will be more fully appreciated as the same becomes better understood when considered in conjunction with the accompanying drawings.

DETAILED DESCRIPTION OF THE PREFERRED EMBODIMENTS

Figure 1:
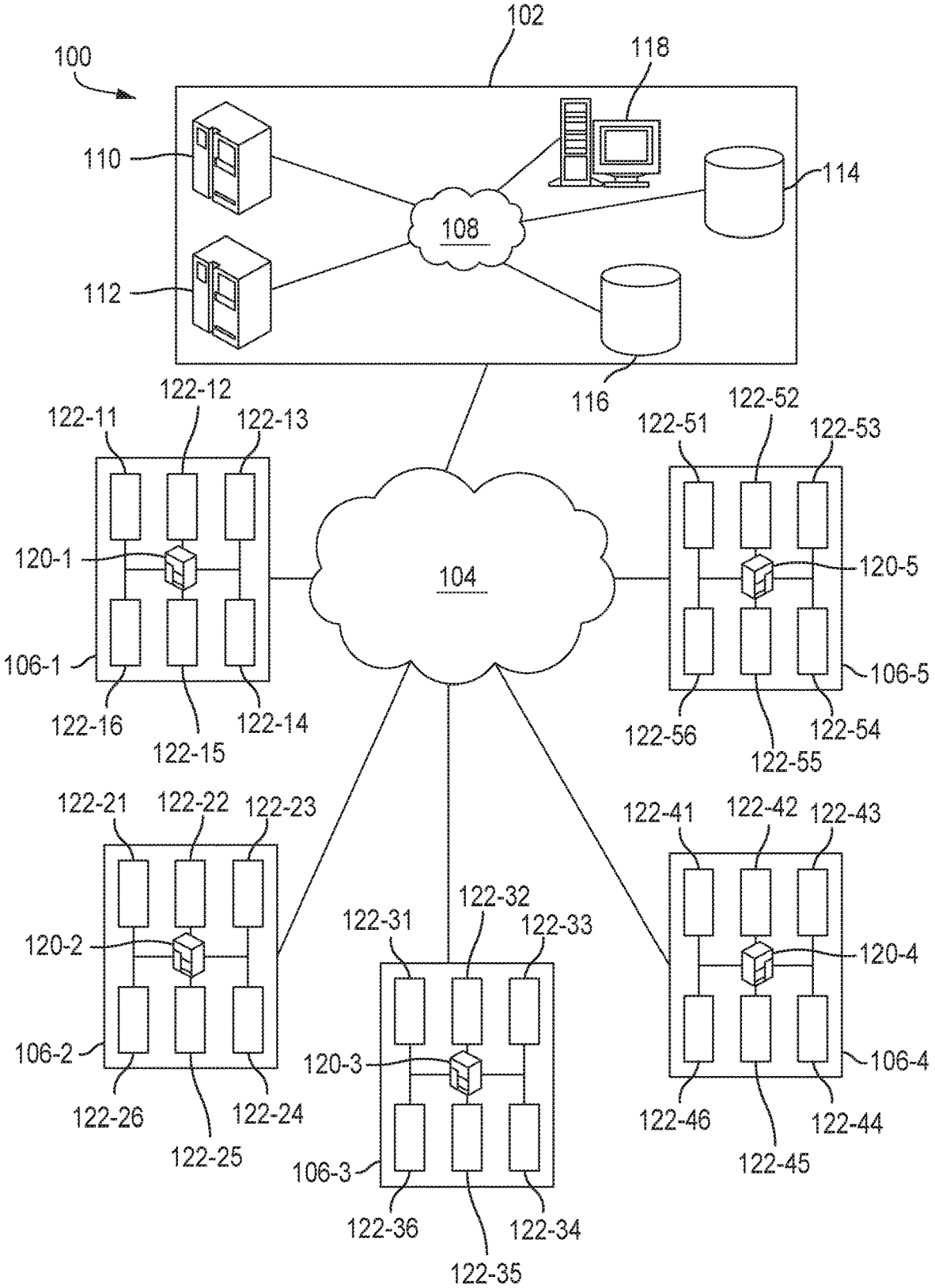
FIG. 1 illustrates a gaming network according to the disclosed embodiments.

Reference will now be made in detail to specific embodiments of the present invention. Examples of these embodiments are illustrated in the accompanying drawings. While the embodiments will be described in conjunction with the drawings, it will be understood that the following description is not intended to limit the present invention to any one embodiment. On the contrary, the following description is intended to cover alternatives, modifications, and equivalents as may be included within the spirit and scope of the appended claims. Numerous specific details are set forth in order to provide a thorough understanding of the present invention.

Online sports gambling offers many different options, systems, league configurations, and the like. Each different type, however, requires a certain level of skill and knowledge to successfully compete. Otherwise, casual fans are taken advantage of by other players having inside knowledge or the ability to devote vast amounts of time to research on which team to pick to win a game, match, or series. Further, some fans do not want to bet against their teams or favorite players yet would like to place wagers on the games. They find themselves not enjoying online gambling.

Fantasy leagues require a season long commitment and an upfront fee. Some players in fantasy leagues subscribe to special services or even use software algorithms to pick optimal teams. Again, this excludes the casual fan that does not want to spend hours researching teams and players. League predators take advantage of casual users as well by playing in newcomer leagues or matches to cheat.

Other issues include betting on sports that are not popular or even conducive for betting. Most leagues involve football, basketball, baseball, and maybe soccer and hockey. Very little online wagering occurs for sports that are not popular or viewed by the public. This may be due to little information available to make an informed wager or not enough interest to warrant gambling websites to host the platforms for such betting.

The disclosed embodiments overcome these problems and others. The disclosed platform configures a grid that allows users to place bets on games, statistics, results, and anything else that results in numbers produced by the event. The numbers are used to determine the winners of the wagers for the event. The grid includes rows and columns, usually in a 10×10 configuration. Numbers are randomly assigned to each row and column. The numbers generated from the event are compared to the randomly assigned numbers to determine winners.

For many years, office pools utilize a similar system using paper grids and picking numbers randomly. The disclosed embodiments differ from such systems as the grid configuration is online. Numbers are randomly assigned and kept secret according to an algorithm. Winners are paid immediately and not after the event or win the other users "pay up." Winners also may be paid out during games and do not need to wait until the end of a season or game to determine. For example, winners may be paid out during the end of periods, quarters, or halves. Due to being online, the matches are made available anywhere and not just in a specific setting or location. The participants in a match may be kept secret from each other. Moreover, a match may be started after the game has started without any aspect of the ongoing game influencing the probability of final winners of the match.

Another difference is that anyone can participate in a match, even players that have no specific knowledge of the game, sport, teams, or players. Success relies on randomly assigned numbers and not on the achievements of a team or player. The disclosed embodiments level the playing field, so to speak, for online gambling. Fans of unpopular teams or sports may participate in matches as well as the only requirement to determine winners is a score or statistical result. Fan interest may be kept in games that become blowouts or boring as the numbers generated during the game influence who wins.

A player of legal age may sign up as a member of the disclosed gaming network. The player uses a credit card or other form of payment to add funds to the gaming account. The player then browses the games available on the website and selects ones of interest. The player enters a match having a grid and purchases boxes or squares within the grid. The player does not see the numbers for the rows and columns within the grid. One does not know what numbers he/she may have for the selected square.

The numbers are randomly generated when the grids are generated. Alternatively, the numbers may be randomly assigned to the rows and columns after the grid is full with bids from players. In any event, players do not know the numbers for the rows and columns when placing their bet. The numbers assigned to the rows and columns are encrypted for full security. Thus, even if the website or platform gets hacked, no one will be able to determine the numbers for the matches. The numbers will become visible once all the squares are purchased.

A single box, or square, in the grid cannot be purchased by more than one player. A single player, however, may purchase more than one box per match. As soon as a box, or square, is purchased, the funds in the internal gaming account are reduced. The system, or website, keeps track of the purchases with details including the amount spent and the date and time of the purchases. When the game is complete, a site administrator may enter the results as numbers. Alternatively, the system may grab the scores from well known sports websites. This action will automatically identify the winning squares in the grid, based on the scores of the teams or sides in the game. The winners may be paid directly or through third party network, or may have the winnings placed into the internal account.

The disclosed embodiments are configured as special purpose hardware within a system, as programmable circuitry appropriately programmed with software or firmware, or as a combination of special-purpose and programmable circuitry. Some embodiments may include a machine-readable medium having stored thereon instructions that are used to processor for a computer or other electronic device to perform a process or series of processes. The machine-readable medium is non-transitory.

FIG. 1 depicts a gaming network 100 according to the disclosed embodiments. Gaming network 100 includes a host computer system 102 and communication network 104 through which a plurality of gaming locations 106 communicate with the host computer systems. Host computer system 102 includes an internal network 108, a web server 110, a game server 112, a game storage database 114, a player storage database 116, and an administrator computing device 118. In some embodiments, various components of host computer system 102 are located together or substantially near each other, such as in the same building. In other embodiments, host computer system 102 may be distributed in that various servers, databases, and devices are located separate from each other and connected through communication network 104. As can be appreciated, a single feature shown in host computer system 102 may actually be embodied by multiple entities. For example, game server 112 may include two or more servers that perform the functionality of the game server.

Gaming network 100 also includes gaming locations 106. Gaming location 106 may include a local server 120 and one or more player devices 122. In some embodiments, local server 120 facilitates communication between players devices 122 and host computer system 102. In other embodiments, local server 120 administers the matches, tracks players and selections, manages player deposits and payouts, and the like. Further, more than one server may act as the local server. These servers may be dedicated to different functions within gaming system 100, as disclosed below.

Gaming locations 106 also may be known as hubs or other terms that designate a local server 120 communicating with host computer system 102. In some embodiments, gaming locations may not be used, such that player devices 122 communicate directly with host computer system 102 to participate in matches and contests online. Further, users of player devices 122 are not prohibited from participating in matches with other users at other gaming locations.

An example process for participating in a gaming match or pool is provided below. Gaming location 106-1 may pertain to a geographical area, such as a zip code or county. Users in this location access a local server 120, usually an online access provider, to participate in gaming network 100. Player devices 122-11, 122-12, 122-13, 122-14, 122-15, and 122-16 are located in this area and associated with a user. Player devices may be computers, smartphones, tablets, gaming consoles, processing units, and the like. The users of these devices log onto gaming network 100 and place bets on matches that relate to actual games and sporting events. The matches will be disclosed in greater detail later.

Another gaming location may be 106-4, which includes player devices 122-41, 122-42, 122-43, 122-44, 122-45, and 122-46. The users of these player devices also may participate in gaming network 100. Host computer system 102 may indicate online through communications network 104 that matches are being held related to a Monday night football game. Users may participate in these matches. Thus, the users, for example, of player devices 122-16, 122-14, 122-53, 122-42, and 122-33 may participate in a match related to the football game. At certain points during the game, one of the users associated with these devices will win, which results in financial compensation to that user. The winning amount may be sent to the user over communication network 104 using administrator computing device 118. The winner will be notified at his/her respective player device.

As can be appreciated, gaming network 100 is not limited to a specific location or group of users. A user in gaming location 106-1 may compete against those in gaming locations 106-2 or 106-5. Further, all matches and gaming events are centralized using host computer system 102. Friends from any location may participate in matches against each other. Unlike "office pools," matches are conducted online and in real-time.

Figure 2:
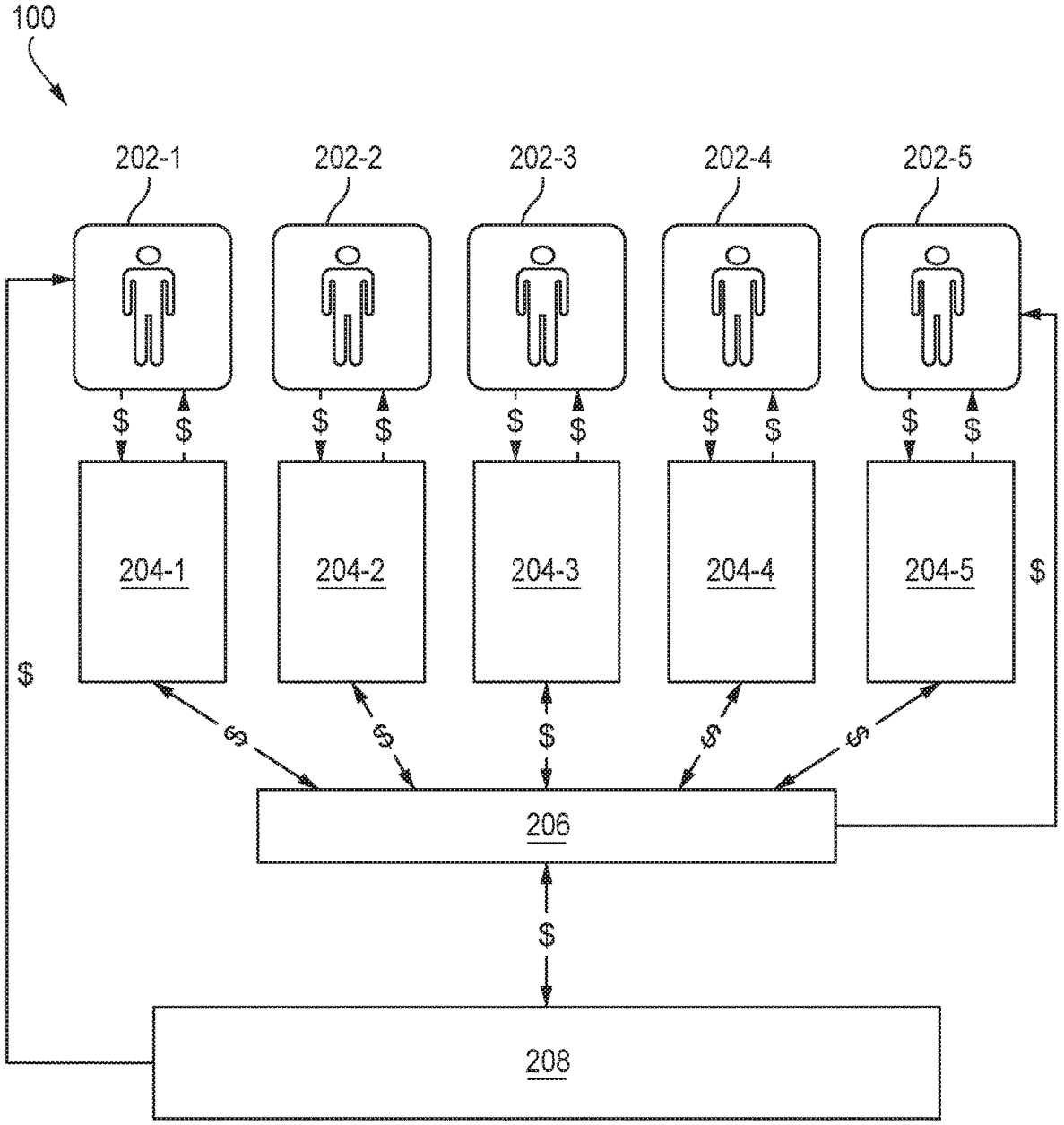
FIG. 2 illustrates the economic components of the gaming network according to the disclosed embodiments.

FIG. 2 depicts the economic components of gaming network 100 according to the disclosed embodiments. FIG. 2 shows the flow of funds within gaming network 100.

Players 202 engage in gaming using devices 204. Players 202 may provide value, such as cash, points, credits, and the like, through devices 204 to engage in the games offered by host computer system 102. Host computer system 102 will provide matches which players 202 participate. When player 202-1 wins a match within gaming network 100, device 204-1 is configured to receive the value of the winnings.

Local depository 206 may receive and distribute funds to players 202. Local depository 206 may be connected to central depository 208, which controls the funds as matches proceed and are completed. Local depository 206 may relate to a location where players 202 are playing, even though devices 204 move. As players 202 and devices 204 move around, different local depositories 206 may interact with them to receive and distribute funds. In some embodiments, value is paid from a local depository 206 to central depository and vice versa. In other embodiments, central depository 208 may pay funds directly to players 202.

In alternative embodiments, local depository 206 may correspond to a fixed location within a business establishment, such as a casino. Gaming network 100 may have a direct relationship with the casino to promote matches and games, while providing special offers to players 202 using gaming network 100 through the casino. For example, players using local depository 206 at the casino may receive reduced entry fees to matches or access to a greater number of sports and matches than players outside the casino. Meanwhile, the casino may pay for use of local depository 206. Local depository 206 confirms the location and status of players 202 to receive these benefits as well as providing real-time feedback to the casino. Central depository 208, however, still controls all receipts and payouts in gaming network 100.

Figure 3:
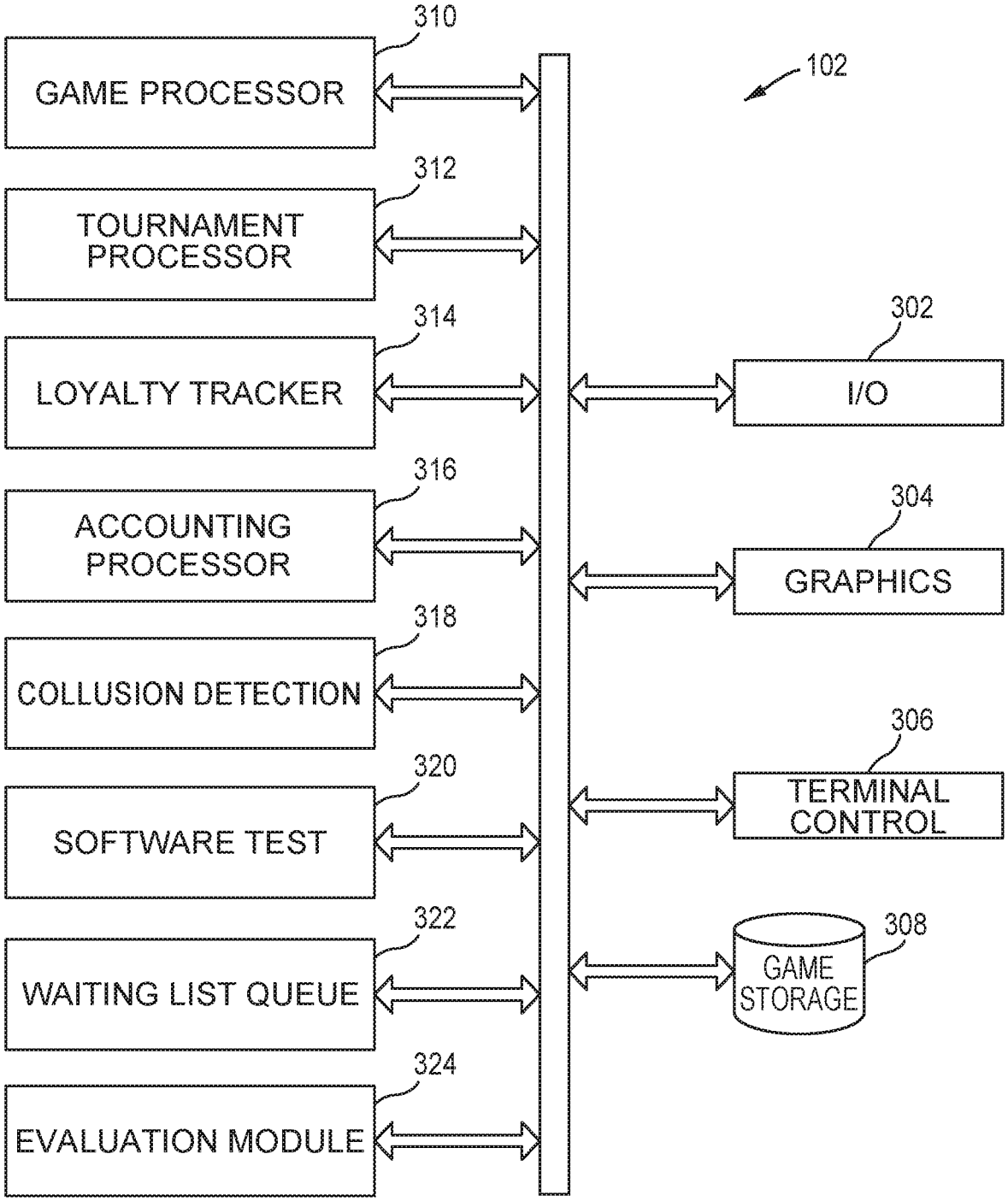
FIG. 3 illustrates an example of a host computer system according to the disclosed embodiments.

FIG. 3 depicts an example of a host computer system 102 according to the disclosed embodiments. FIG. 3 shows several program modules as well as computer functions that configure host computer system 102 into a special purpose machine. I/O module 302 handles input to and output from a processing environment or communication network 104. Graphics module 304 provides control over the graphics displayed on devices, computers, administrative terminals, and the like. Terminal control module 306 provides the capability of host computer system 102 to interact with or control a player device within gaming network 100. Game storage arrangement 308 stores software or other computer-executable code that controls the games or matches offered over gaming network 100.

A game processor 310 may control one or more matches or games using the computer executable code from game storage arrangement 308. A tournament processor 312 performs a similar function for possible tournaments. A loyalty tracker 314 keeps information about the participation of registered players to thereby reward players for the number of matches or amount of time they spend using gaming network 100. An accounting processor 316 may control the flow of funds or other forms of value within gaming network 100. A collusion detection processor 318 monitors such occurrences as unusual action taken by a specific player, frequent violations of gaming rules, fraud or attempted fraud, and the like.

A software test environment allows new games, matches, or processes to be tested in an environment that does not affect ongoing operations. This may be especially important to not disrupt ongoing matches within gaming network 100. As can be appreciated, matches related to sporting events may occur around the clock as the matches are not limited by time zone or location. A waiting list queue 322 allows players to wait in line for a specific match, sport, and the like. For example, players may wish to participate in a baseball game between two fierce rivals. As matches are set up, then players are taken from waiting list queue 322. An evaluation module 324 allows for the monitoring of the communication latency between the devices of the players and host computer system 102.

Figure 4:
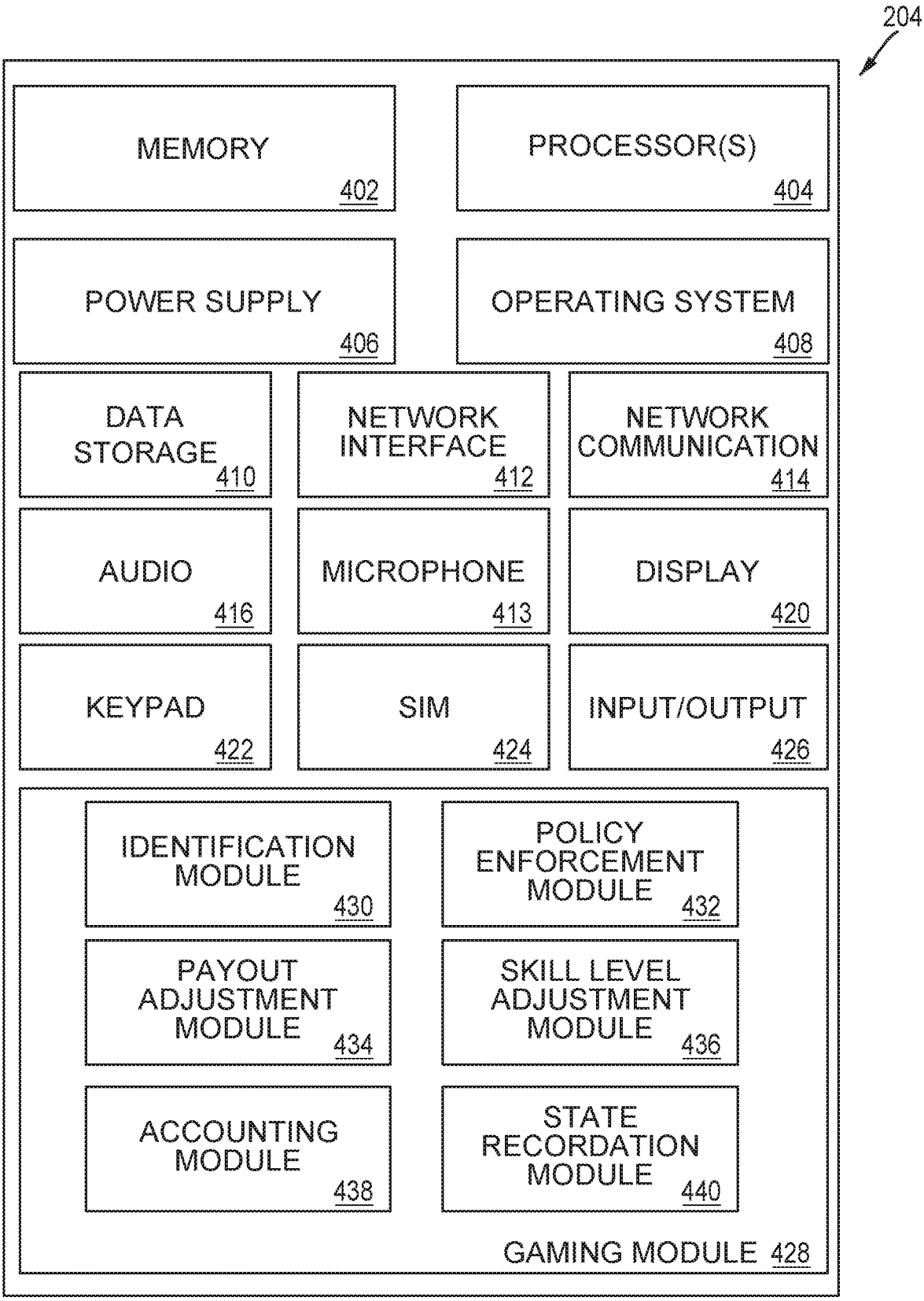
FIG. 4 illustrates components of a device used by a player within the gaming network according to the disclosed embodiments.

FIG. 4 depicts components of a device 204 used by a player 202 within gaming network 100 according to the disclosed embodiments. Device 204 may be a computing device that hosts various applications and programs. In some embodiments, device 204 is configured to become a special purpose machine to implement a gaming module 428 to use within gaming network 100.

Device 204 includes memory 402, such as volatile memory or nonvolatile memory, processor(s) 404, power supply, or battery, 406, and operating system 408 for executing instructions. Additional components may include data storage component 410, such as a hard drive, a flash drive or memory, a memory card, and the like, one or more network interfaces 412, and network communication interface 414, which enables device 204 to communicate by transmitting and receiving wired and wireless signals over networks, audio interface 416, SIM card 424, other input or output interfaces 426, and gaming module 428. The components shown therein may be connected by a bus.

Memory 402 may be used to store instructions for running one or more applications or modules on at least one processor 404. For example, memory 402 could be used in one or more embodiments to store all or some of the instructions needed to execute the functionality of the various system components or modules. One or more processors are the main processors of device 204, which may include application processors, baseband processors, various coprocessors, and other dedicated processors for operating device 204. An application processor may provide the processing power to support software applications, memory management, graphics processing, and multimedia functions. An application processor may by communicably coupled with memory 402 and configured to execute operating system 408, a user interface, and the applications stored on memory 402 or data storage component 410.

A baseband processor may be configured to perform signal processing and implement/manage real-time radio transmission operations of a device, such as a mobile device. These processors, along with the other components, may be powered by power supply 406. The volatile and nonvolatile memories found the various embodiments may include storage media for storing information, such as processor-readable instructions, data structures, program modules, and other data. Some examples of information that may be stored include basic input/output systems (BIOS), operating systems, and applications. Operating system 408 may provide common services for software applications executing on one or more processors 404.

Gaming module 428 may include identification module 430, policy enforcement module 432, payout adjustment module 434, skill level adjustment module 436, accounting module 438, and state recordation module 440. Each of these modules can be embodied as special-purpose hardware or as programmable circuitry, such as one or more processors, appropriately programmed with software or firmware, or as a combination of special purpose hardware and programmable circuitry.

Identification module 430 may be used to gather information about the device, current or past gaming sessions, player information, specific hardware, and software configurations of the device, GPS coordinates, associated telephone numbers, IP addresses, email addresses, user identifiers, international mobile station equipment identity (IMEI), mobile equipment identifiers (MEID), integrated circuit card identifiers (ICCID), part identifiers, software identifiers, current gaming or match session identifiers, identification of nearby player devices, and the like. This information may be used in variety of ways, including policy enforcement module 432 that can set customized collusion avoidance policies that can, in some embodiments, be dynamically set, based on location, current gaming session, and the like.

Payout adjustment module 434 may be used to dynamically adjust the payout of a gaming or match session. For example, there may be minimum payout requirements, such as during times in the game or match, such as halftime or the end of the game. Payout adjustment module 434 may ensure that winnings are provided as soon as possible to players so that there is no lag or delay associated with other online gambling platforms. Payout adjustment module 434 also may adjust the payout based on rules associated with the match. For example, some matches may take a fee or percentage of the top of the money involved in the match. Using the example, there may be a 1% fee to cover processing and overhead for conducting the match. The percentage may be different depending on the location of the player or other factors. Frequent players may have these fees waived.

Skill level adjustment module 436 may be used to adjust playing parameters for matches. For example, the higher the skill level, then the more matches one can participate. One who knows how to participate in matches can be access additional or higher stakes matches. Accounting module 438 may be used to interface with various existing backend accounting systems, reporting systems, and record keeping systems. In some embodiments, accounting module 438 may be used to implement procedures that are designed to detect and prevent transactions that may be associated with money laundering, fraud or other criminal activities, and to ensure compliance with all federal and state laws.

State recordation module 440 may be used to capture the state of a match. The "state" may include a variety of game states including wagers, payout levels, skill level settings, and others. The state of the gaming session may be repeatedly captured so that in the event of a communication failure, device fault, or the problem, a record of the current state may be reconstructed. For example, the state may be captured every second or depending on match dynamics. The state captured by state recordation module 440 also may be used by a collusion avoidance module to determine if any collusion is occurring. The state information captured by state recordation module 440 may be used to generate various game and match analytics. Host computer system 102 may capture the state information directly from the device.

State recordation module 440 may store the state information in a database for regulatory compliance, analytics, or other purposes. For example, all game play within a period of time may be recorded and stored in the database. In other embodiments, a limited number of gaming sessions may be recorded, such as the last one hundred matches. Other embodiments may include state recordation module 440 recording state information for matches over a set threshold, such as 1000.

In some embodiments, the devices used by the players to access gaming network 100 may provide for social media, chatting, and other communication channels. For example, some embodiments may have interfaces that allow for third party access through another gateway, such as Facebook™ or other social media platforms. Some embodiments of the devices may allow for picture in picture or multiple screens. As a match is occurring, a player may talk with other players in the match and share opinion about the play of the teams.

Figure 5:
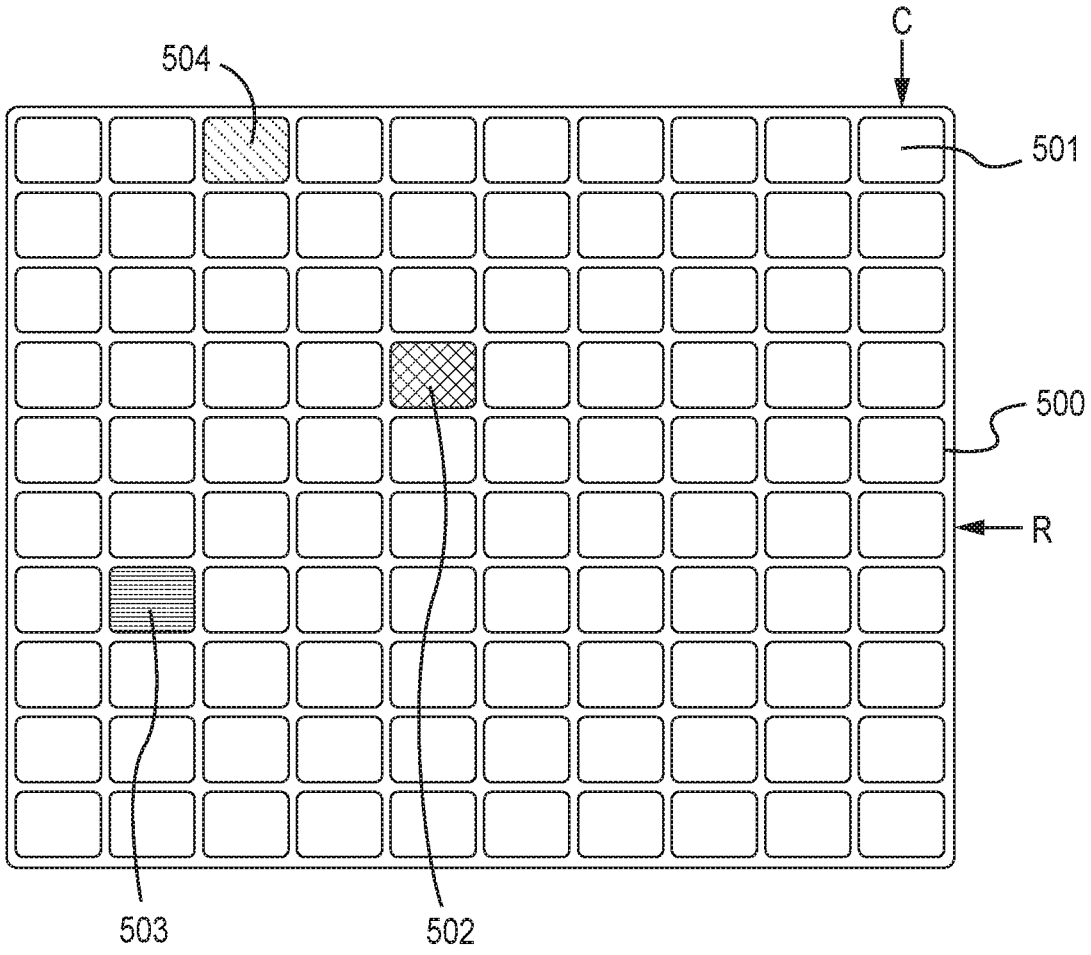
FIG. 5 illustrates a match grid for use in the gaming network according to the disclosed embodiments.

FIG. 5 depicts a match grid 500 for use in gaming network 100 according to the disclosed embodiments. As disclosed above, a match corresponds to a game or other sporting event, such as a meet or tournament, is planned. Game may refer to any event where scores or statistics are generated based on the efforts of participants. The outcome is not predetermined. Further, the game is not one of "chance" where there are predictable or even odds of winning, such as blackjack. The scores in the game are generated during the game and over a period of time. The scores are readily identifiable and trackable.

In some embodiments, grid 500 is generated when one or more players 202 in gaming network 100 want to initiate a match. Host computer system 102 may generate grid 500 automatically for games or at the request of a player. Preferably, grid 500 is a 10×10 grid to represent the numbers from 0-9. The numbers relate the "ones" digit in a score. For example, a score of 84 would be a "4" in the grid. As disclosed later, the numbers are randomly assigned to each column C and row R of grid 500.

Grid 500 is displayed on a screen of a device connected to gaming network 100. Thus, squares 501 also are shown. Given a 10×10 grid, there should be 100 squares 501 available for a match. The squares may have different graphical properties depending in their status. A clear square, such as square 501, indicates no one has selected that square yet. It is available for selection. A darkened square 503 may indicate that the square is taken and not available for selection. If the player clicks or indicates darkened square 503 for selection, a prompt may be displayed that the square is not available. A shaded square 502 may indicate that the square has been selected but funds for the selection, or bet, have not been received. Gaming network 100 will not assign the square to a player until appropriate funds have been received. Again, a prompt may be displayed that the square is unavailable. If the player selecting square 502 cannot pay the bet, then the square becomes available for selection. The player can wait a few minutes to see if it becomes available. A lightly shaded square 504 may indicate that a player is thinking about that square, but has not initiated payment for it. The player might be debating whether to participate or not. Lightly shaded square 504 still may be available for purchase if the player looking at grid 500 acts accordingly. The player also may select square 504 without a prompt indicating it is taken. If the player funds his/her account to purchase the square, then he/she will obtain it for the match.

In other embodiments, different sized grids 500 may be generated. A range may be used to determine the winning squares, such as 0-1, 2-3, or so on. This grid would be 5×5. Some games may not have scores above a certain amount, such as a European football game. A grid for such a game may rarely exceed 4 goals on either side. In this instance, rows R and columns C may be generated for numbers 0-4, with separate ones for 5-9. The generation of grid 500 is dynamic and adjustable.

Figure 6:
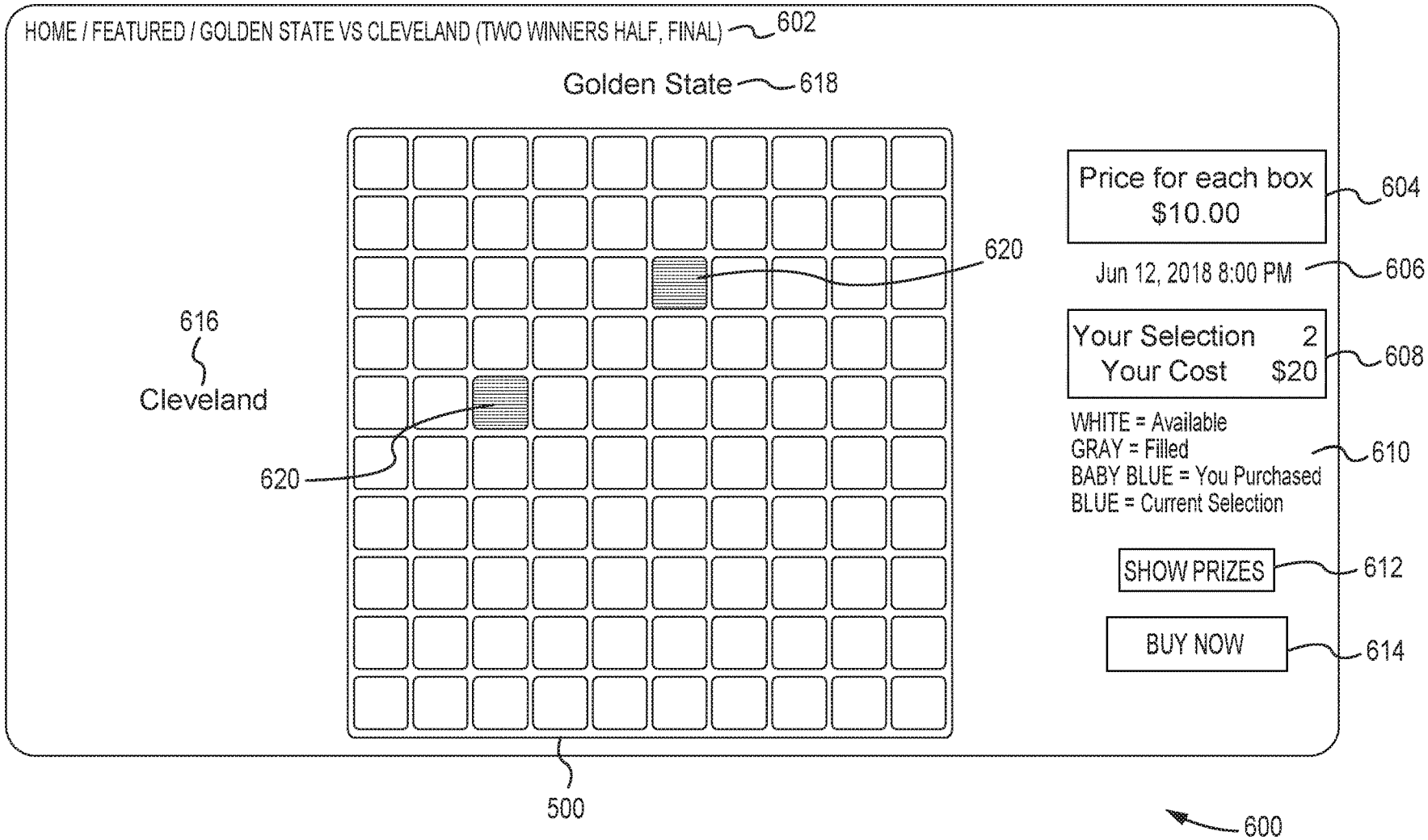
FIG. 6 illustrates a match screen for a game using the gaming network according to the disclosed embodiments.

FIG. 6 depicts a match screen 600 for a game using gaming network 100 according to the disclosed embodiments. Match screen 600 may be displayed on a device connected or accessible by gaming network 100. Match screen 600 includes grid 500. Grid 500 includes the squares that are selected by placing bets or wagers associated with the match. As the squares are selected, grid 500 fills up until every square is selected. At that time, numbers are assigned randomly to each row R and column C Grid 500 in match screen 600 is not yet filled so no numbers have been assigned.

Match screen 600 includes information about the game to which it corresponds and the account for the player. Match detailed information 602 may be displayed along with the time events that payouts will occur, such as quarter, half, and the end of the game. It also may list the participants of the game, also shown with grid 500. Team 616 may be assigned rows R while team 618 may be assigned columns C. The numbers assigned to rows R will pertain to the scores of team 616 while the numbers assigned to columns C will pertain to the scores of team 618. Designation of which team is placed where may be based on home-visitor team status, favored teams, randomly, and the like.

Match screen 600 also includes various boxes and buttons to help the player select and purchase squares in grid 500. Display box 604 indicates that price for a square for the match. Prices may be different between matches even though they relate to the same game. Display box 606 indicates that date and time of the game. Alternatively, it may display the current date and time. It also may indicate any cut off times or dates to participate in the match and select squares.

Display box 608 indicates the number of squares currently selected in their cost. The selected squares are shown in grid 500 as darkened squares 620. If the player has not purchased squares 620, then they may exhibit a lighter shade. Display box 610 may provide a legend for noting that status of the squared in grid 500. This legend may or may not be similar to the explanations provided above for FIG. 5. Button 612 may be displayed. If button 612 is selected, then the prizes associated with this match are shown. Button 614 allows the player to purchase the selected squares according to the costs shown in display box 608.

Figure 7:
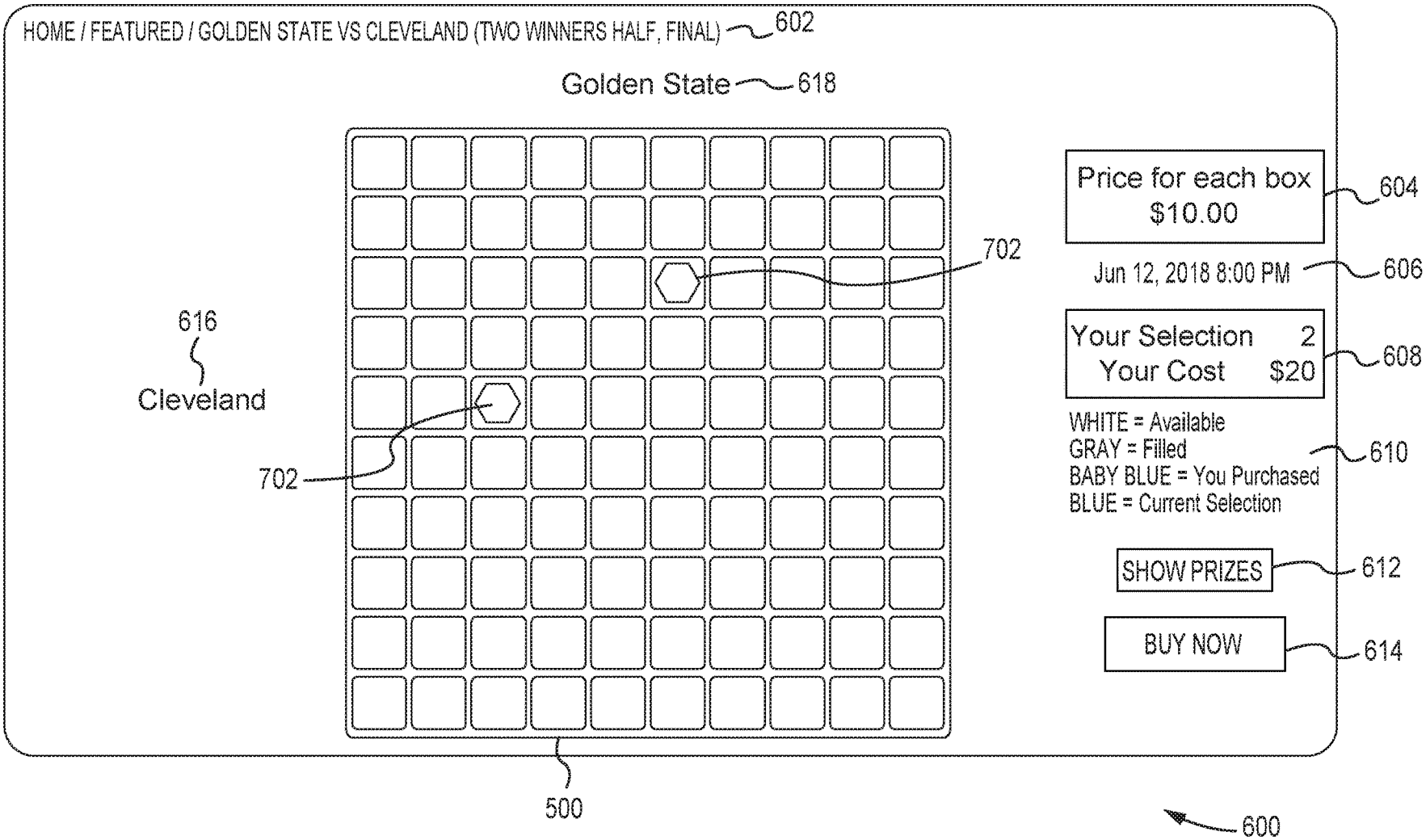
FIG. 7 illustrates the match screen after purchase of squares within the gaming network according to the disclosed embodiments.

FIG. 7 depicts match screen 600 after purchase of squares within gaming network 100 according to the disclosed embodiments. Match screen 600 is pretty much the same as the one shown in FIG. 6, except the player has completed purchases of squares 620. These are shown as purchased squares 702. As can be seen, no numbers are assigned to rows R or columns C yet. Thus, the player does not know which numbers are associated with squares 702. Display box 608 may be updated to show that the player has no more selections left and that the ones for squares 702 have been purchased.

As can be seen, purchased squares 702 include a graphic or icon. The icon may serve to indicate the player to other people in the match. Other players will know that the player is participating in this match for the Cleveland-Golden State game. As one browses for matches to engage, he/she can see the icons for purchased squares and decide to play based on who is involved. Icons also may serve for the organizer of a match to identify players that do not belong. For example, an office match may only allow participation by designated employees of the company. Each employee has an icon that allows everyone to know if someone outside the company is participating.

Figure 8:
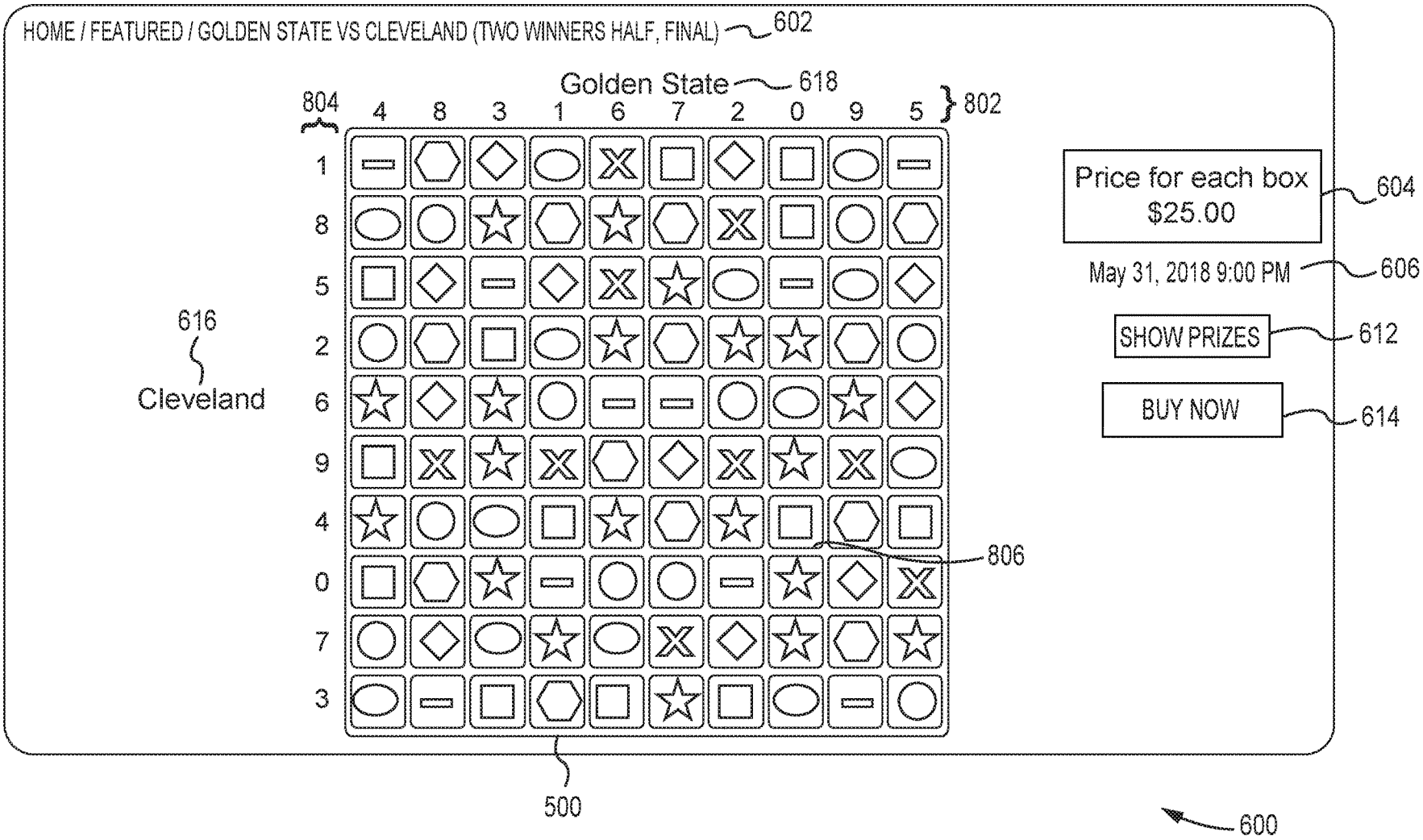
FIG. 8 illustrates the match screen with a completed grid according to the disclosed embodiments.

FIG. 8 depicts match screen 600 with a completed grid 500 according to the disclosed embodiments. Completed grid 500 has every square selected and paid for. Thus, this match for the Cleveland-Golden State game is filled. No further squares may be purchased. As shown in FIG. 8, different graphics are used for the different players. One can know what players are involved by seeing the avatar or icon for the players. Match screen 600 also includes display boxes 604 and 606 and buttons 612 and 614.

A difference between match screen 600 of FIG. 8 and the other screens is the use of match numbers for the rows and columns After every square is purchased, the disclosed embodiments randomly assign numbers between 0-9 for each row and each column. After a number is assigned, it is removed from the pool of numbers to assign to the remaining rows or columns Thus, every number between 0-9 is assigned. The process is disclosed in greater detail below.

Column numbers 802 correspond to the ones digit of the score by Golden State. Column numbers 802 are assigned randomly starting with the column at the left side of grid 500. As shown, the number assigned to this column is 4. The number 4 is then removed from the pool of available numbers. The process moves to the next column and randomly assigns the number 8, which is then removed from the pool of available numbers. This proceeds until the right most column of grid 500 is reached. The only number left in the pool is 5, so it is assigned to this column.

The randomly assignment process is repeated from row numbers 804, which corresponds to the ones digit of the score for Cleveland. The process may start with the uppermost row of grid 500 and proceeds downwards to the bottom row. Thus, each square in grid 500 has a unique column, row number assignment. For example, the square in the upper left corner is 4,1. The square corresponding to 6,9 is in the middle portion of grid 500.

Payout events may be instances during the game where the scores of the teams are used to payout winnings to players. At the payout event, the score of each team is noted. The ones digits of the scores, such as 7 of 27, are used to select the appropriate row and column number. Each team's score is used. Once the ones digits are available, the winning square is determined within grid 500. For example, after the first quarter, the score is Cleveland 24 and Golden State 30. The ones digits are 4 and 0. The disclosed embodiments go to the row having the number 4 and the column having the number 0. This square is shown by winning square 806 in FIG. 8. This process is repeated for each payout event until the game is over.

Figure 9:
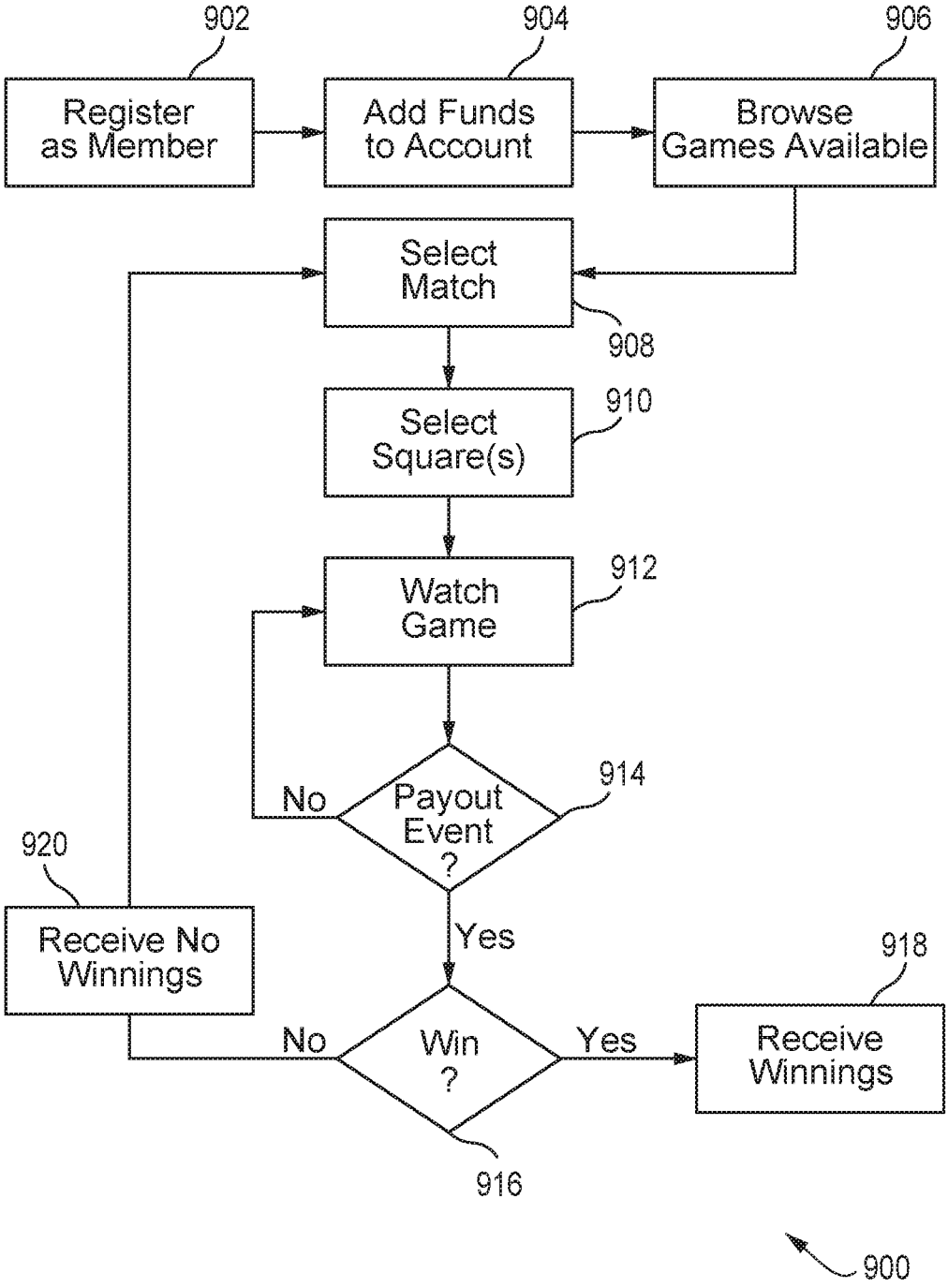
FIG. 9 illustrates a flowchart 900 for playing in a match according to the disclosed embodiments.

FIG. 9 depicts a flowchart 900 for playing in a match according to the disclosed embodiments. Flowchart 900 may relate to how a player signs up and participates in gaming network 100. Step 902 executes by registering the player as a member of gaming network 100. The player may enter the usual information, such as name, email, password, icon or avatar, interests, favorite teams, and the like. Step 904 executes by adding funds to the player's account. The funds will be used for wagers in matches to purchase squares. The amount of funds available may be shown in a display box on match screen 600.

Step 906 executes by browsing for games available in which to participate. One may browse by league, team, player, and the like. Step 908 executes by selecting a match to play. The match should display a grid 500 with available squares to purchase, as disclosed above. Step 910 executes by selecting one or more squares with the funds available. Once grid 500 is filled, no further squares may be purchased and the match is locked.

Step 912 executes by watching the game. In other words, the game starts and accumulates scores between each team or player. At certain instances during the game, payout events occur. Thus, step 914 executes by determining whether a payout event has occurred. If no, then flowchart 900 returns back to step 912. If step 914 is yes, then step 916 executes by determining whether the player had a winning square during the payout event. The scores from each team is used to determine the row number and the column number used to determine the winning square. If step 916 is yes, then step 918 executes by receiving the winnings by the player. A prize for the match is paid out. If step 916, then step 920 executes by the player receiving no winnings for the match.

Flowchart 900 may return back to step 908 unless the game is still ongoing. If so, then flowchart 900 returns to step 912. Flowchart 900 may repeat this process until the game is over. Then, the match is done and all prizes paid out.

Figure 10:
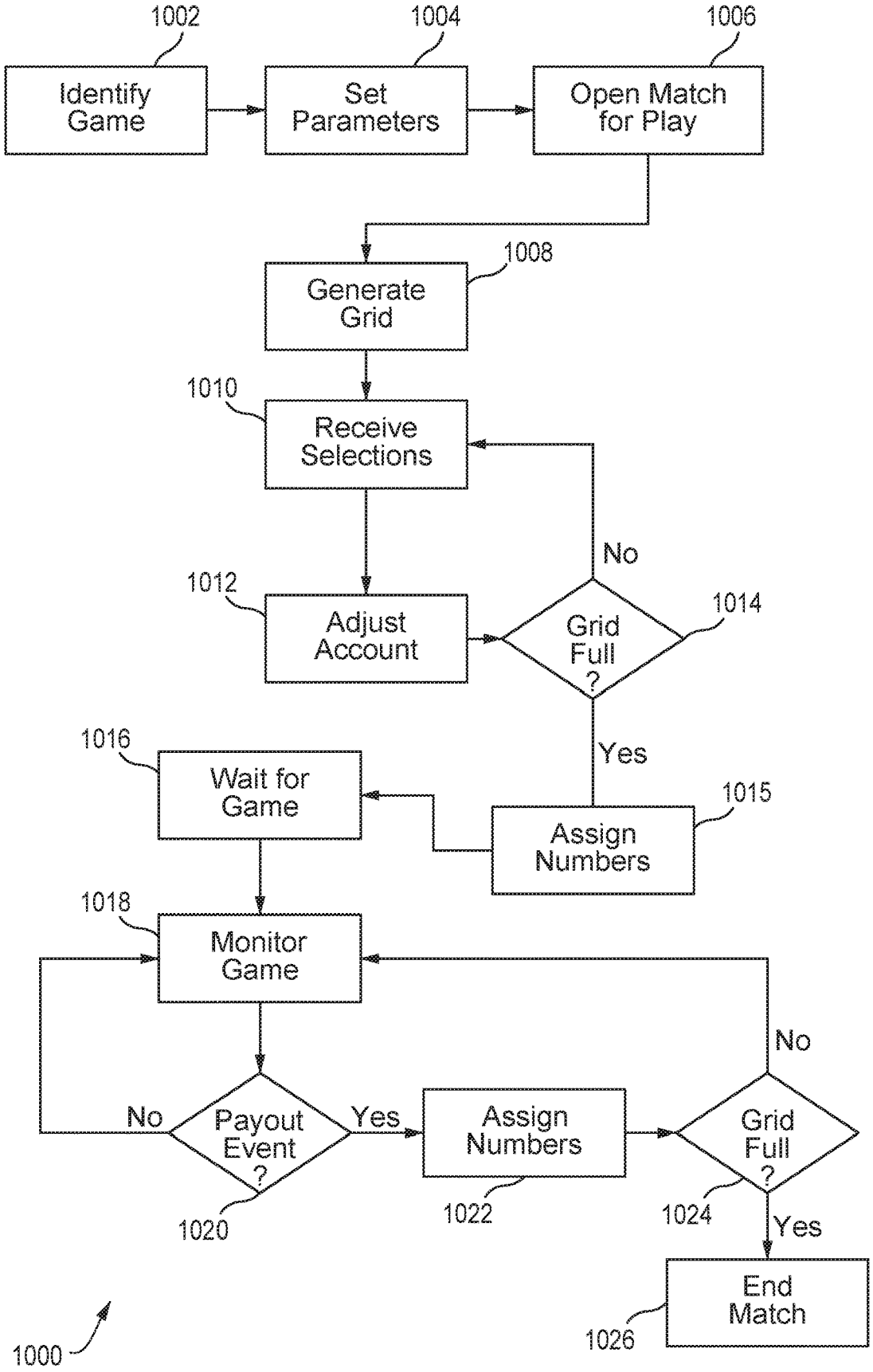
FIG. 10 illustrates a flowchart 1000 for generating a grid and playing a match according to the disclosed embodiments.

FIG. 10 depicts a flowchart 1000 for generating a grid and playing a match according to the disclosed embodiments. Flowchart 1000 is disclosed from the perspective of host computer system 102 of gaming network 100. Step 1002 executes by identifying a game for which to provide matches to players. As noted, most sporting events may be used for matches. Step 1004 executes by setting parameters for the matches corresponding to the game. Parameters may include when payout events occur, price per square, limits on the number of squares one can purchase for a match, skill level of the players, and the like. Parameters also include how many rows and columns will be used in the grid for the scoring breakdown. Most matches will use 0-9 but other number combinations may be used for specific sports.

Step 1006 executes by opening at least one match for play corresponding the game. Multiple matches may be set up for each game. Thus, for each match, step 1008 executes by generating a grid based on the number of rows and columns for the scores. The parameters may determine the number of rows and columns Step 1010 executes by receiving selections by players for the squares in grid 500. After each purchase, step 1012 executes by adjusting the account for that player. The amount for a bid on a square is withdrawn times the number of squares selected.

Flowchart 1000 then goes to step 1014. Step 1014 executes by determining whether grid 500 is full. If no, then flowchart 1000 returns to step 1010 to continue receiving selections for square and receiving payments. If step 1014 is yes, then step 1015 executes by assigning the random numbers to the rows and columns as disclosed above. The numbers for the rows and columns are not known to the players until grid 500 is full. Thus, no one can purchase squares for specific scores. Numbers also may be encrypted until a full review is made for the match. For example, the numbers may be compared to other matches to make sure that certain patterns are not repeated or redundant. An algorithm may determine whether the final grid is acceptable.

In an alternative embodiment, step 1015 may be executed after step 1008, when grid 500 is generated. Row numbers 802 and column numbers 804 are assigned but encrypted for secrecy. Thus, the processing for each match may be reduced as host computer system 102 does not need to wait until the squares in grid 500 are full to finalize numbers. This process may be preferred in the event that not every square is purchased. The match may still go on as planned. Winning squares under this scenario may not result in any prizes for that payout event. The prizes or winnings may be added to the next payout event or may be forfeited to gaming network 100.

Step 1016 executes by waiting for the game to commence. Step 1018 executes by monitoring the game once it starts and the scores as they accumulate. Step 1020 executes by determining whether a payout event occurred. If no, then flowchart 1000 returns to step 1018 to continue monitoring the game. If step 1020 is yes, then step 1022 executes by paying out the winnings for the match based on the parameters. After the winnings are paid out, then step 1024 executes by determining whether the game is over. In other words, no time is left to play the game. If no, then flowchart 1000 returns to step 1018. If step 1024 is yes, then step 1026 executes by ending the match.

As can be seen, any level of player may participate in a match corresponding to a game. One does not need to follow teams, leagues, players, and other specific knowledge to compete. The odds to win are balanced and even across the grid. The only way to increase one's odds of winning is to purchase more scores. Gaming network may limit the number of squares one may purchase for a match in order to allow more players to compete.

It will be apparent to those skilled in the art that various modifications to the disclosed embodiments without departing from the spirit or scope of the invention. Thus, it is intended that the present invention covers the modifications and variations disclosed above provided that these changes come within the scope of the claims and their equivalents.

The invention claimed is:

1. A method for hosting an online match corresponding to a game over a private network, wherein the game includes two teams or sides, each team having a score, the method comprising:

generating a grid having a plurality of rows and a plurality of columns for the online match, wherein the grid includes a plurality of squares, each square of the plurality of squares having a unique location within the grid corresponding to random numbers assigned to each row of the plurality of rows and to each column of the plurality of columns and further wherein a first team is associated with the plurality of rows and a second team is associated with the plurality of columns;

receiving a selection for one or more squares within the grid according the rows and columns, wherein the selection corresponds to a purchase amount based on the number of selected squares;

assigning a first graphical property to the one or more squares, wherein the first graphical property indicates that the one or more squares are still available for purchase;

receiving payment of the purchase amount over the network from a local depository within the private network and associated with a location of a player on the network, wherein the local depository changes as the location of the player changes;

depositing the payment of the purchase amount into a central depository for the private network from the local depository;

assigning a second graphical property to the one or more squares, wherein the second graphical property includes an icon to identify the player and indicates that the one or more squares are not available for purchase;

repeating the receiving steps until the grid is full or ready to close;

determining a score for the first team and a score for the second team at a payout event during the game;

identifying a winning square from the plurality of squares based on the scores, wherein the score for the first team is used to identify a row in the grid and the score of the second team is used to identify a column in the grid that includes the winning square; and paying a prize or winning amount based on the winning square to the local depository from the central depository.

2. The method of claim 1, further comprising selecting the grid from a plurality of grids generated for the online match.

3. The method of claim 1, further comprising capturing a state of the online match.

4. The method of claim 1, wherein the paying the prize or winning amount includes distributing the prize or winning amount from a local depository.

5. The method of claim 1, further comprising masking the random numbers until the grid is full or closed.

6. A method for placing a bet for an online match corresponding to a game, wherein the game includes two teams or sides, each team having a score, the method comprising:

accessing the online match through an application or website connected to a private network;

selecting one or more squares in a grid, wherein the grid includes a plurality of rows associated with a first team and a plurality of columns associated with a second team, each row having a randomly assigned number and each column having a randomly assigned number;

assigning a first graphical property to the one or more squares, wherein the first graphical property indicates that the one or more squares are still available for purchase;

paying a purchase amount based on the number of selected squares from a local depository within the private network and associated with a location of a player on the network, wherein the local depository changes as the location of the player changes, wherein each selected square has a unique location within the grid based on its position within the plurality of rows and the plurality of columns;

depositing the payment of the purchase amount into a central depository for the private network from the local depository;

assigning a second graphical property to the one or more squares, wherein the second graphical property includes an icon to identify a player within the game and indicates that the one or more squares are not available for purchase;

determining a score for the first team and a score for the second team at a payout event during the game;

identifying a winning square for the payout event by row identified from the score for the first team and a column identified by the score of the second team; and automatically paying a prize or winnings based on the winning square from the central depository to the local depository.

7. The method of claim 6, further comprising randomly assigning the numbers to each row and to each column after paying the purchase amount.

8. The method of claim 6, further comprising monitoring a transmission of the game to receive score updates.

9. An online gaming system for hosting an online match corresponding to a game over a private network, wherein the game includes two teams or sides, each team having a score, the online gaming system configured to generate a grid having a plurality of rows and a plurality of columns for the online match, wherein the grid includes a plurality of squares, each square of the plurality of squares having a unique location within the grid corresponding to random numbers assigned to each row of the plurality of rows and to each column of the plurality of columns and further wherein a first team is associated with the plurality of rows and a second team is associated with the plurality of columns;

receive a selection for one or more squares within the grid according the rows and columns, wherein the selection corresponds to a purchase amount based on the number of selected squares;

assign a first graphical property to the one or more squares, wherein the first graphical property indicates that the one or more squares are still available for purchase;

receive payment of the purchase amount over the network from a local depository within the private network and associated with a location of a player on the network, wherein the local depository changes as the location of the player changes;

deposit the payment of the purchase amount into a central depository for the private network from the local depository;

assign a second graphical property to the one or more squares, wherein the second graphical property includes an icon to identify a player within the game and indicates that the one or more squares are not available for purchase;

repeat the receive action until the grid is full or ready to close;

determine a score for the first team and a score for the second team at a payout event during the game;

identify a winning square from the plurality of squares based on the scores, wherein the score for the first team is used to identify a row in the grid and the score of the second team is used to identify a column in the grid that includes the winning square; and pay a prize or winning amount to the purchaser of the winning square from the central depository to the local depository.

* * * * *